US007168413B2

(12) United States Patent
Oono

(10) Patent No.: US 7,168,413 B2
(45) Date of Patent: Jan. 30, 2007

(54) FUEL INJECTOR CONTROL APPARATUS FOR CYLINDER INJECTION TYPE INTERNAL COMBUSTION ENGINE

(75) Inventor: Takahiko Oono, Hyogo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 300 days.

(21) Appl. No.: 10/916,558

(22) Filed: Aug. 12, 2004

(65) Prior Publication Data

US 2005/0126542 A1 Jun. 16, 2005

(30) Foreign Application Priority Data

Dec. 16, 2003 (JP) ..... 2003-418593

(51) Int. Cl.
*F02M 51/00* (2006.01)
*F02M 51/08* (2006.01)

(52) U.S. Cl. ..... 123/479; 361/187

(58) Field of Classification Search ..... 123/479, 123/472, 480, 490, 198 D; 361/187, 139, 361/169, 170
See application file for complete search history.

(56) References Cited

U.S. PATENT DOCUMENTS 3,569,826 A * 3/1971 Burnett ..... 361/170
4,905,120 A * 2/1990 Grembowicz et al. ..... 361/154
6,024,064 A * 2/2000 Kato et al. ..... 123/179.17
6,044,823 A * 4/2000 Watanabe ..... 123/490
6,932,743 B2 * 8/2005 Zieles et al. ..... 477/187

FOREIGN PATENT DOCUMENTS

JP 62-290111 A 12/1987
JP 9-112735 A 5/1997
JP 10-318025 A 12/1998
JP 3336905 B2 8/2002

* cited by examiner

*Primary Examiner*—Mahmoud Gimie
(74) *Attorney, Agent, or Firm*—Sughrue Mion, PLLC

(57) ABSTRACT

A fuel injector control apparatus for a cylinder injection type engine includes driving circuits each shared by plural fuel injectors classified groupwise and having one ends connected in common to a potential source, switching means (13, 17, 19) connected to the potential source for turning on/off driving currents supplied to the injectors of a same group, a fuel quantity/injection timing arithmetic means (2) for determining a fuel supply quantity and a fuel injection timing on the basis of outputs from various sensors (1), driving circuits (10, 20) for firing the switching means in response to output of the fuel quantity/injection timing arithmetic means (2), and a ground fault identifying/discriminating means (2) for specifying a fault location upon occurrence of a ground fault. When the fault location is specified, fuel injection from other injector of the injector group to which the fault suffering injector belongs is stopped.

16 Claims, 8 Drawing Sheets

FUEL INJECTOR CONTROL APPARATUS FOR CYLINDER INJECTION TYPE INTERNAL COMBUSTION ENGINE

BACKGROUND OF THE INVENTION

1. Field of the Invention

The present invention generally relates to an apparatus for controlling fuel injectors of an internal combustion engine of cylinder injection type mounted on a motor vehicle. More particularly, the present invention is concerned with a fuel injector control apparatus for the cylinder injection type internal combustion engine which apparatus can ensure a failsafe function upon occurrence of a ground fault of a fuel injector.

2. Description of Related Art

In recent years, there has been developed and employed as the engine for motor vehicles a cylinder injection type internal combustion engine in which fuel injectors are installed on a cylinder-by-cylinder basis for directly injecting fuel into the cylinders at a high pressure in order to realize enhanced combustion efficiency.

In such cylinder injection type internal combustion engine, it is necessary not only to drive or actuate the fuel injectors at a high speed regardless of high pressure of the fuel but also to control the time duration of the fuel injection with a high accuracy.

To this end, the driving circuit for driving or actuating the fuel injector is so arranged that in an initial phase of injection valve opening operation, a high voltage is applied across an electromagnetic coil of the fuel injector for opening the injection valve, while after the injection valve has been opened, a constant current of a necessary minimum magnitude required for holding the injection valve in the opened state is fed for thereby preventing or suppressing generation of heat in the coil of the fuel injector. In reality, various types of injector driving circuits have heretofore been proposed in the art. For example, refer to Japanese Patent Application Laid-Open No. 318025/1998 (JP-A-1998-318025).

In the fuel injector driving/controlling apparatus disclosed in JP-A-1998-318025 mentioned above, the fuel supply quantity and the fuel injection timing for the engine are arithmetically determined on the basis of the information concerning the engine operation state derived from the outputs of various types of sensors, and the coils of the injectors provided on a cylinder-by-cylinder basis are electrically energized or excited from a battery onboard the motor vehicle. There are provided an injector driving circuit common to or shared by the fuel injectors of the first cylinder and the fourth cylinder on one hand and an injector driving circuit common to or shared by the fuel injectors of the second cylinder and the third cylinder on the other hand.

Further, there has been proposed an injector driving/controlling apparatus which differs in the circuit configuration from the apparatus disclosed in JP-A-1998-318025 in that a power supply circuit is shared by all the fuel injectors and which can thus be implemented at a lower manufacturing cost. Reference is to be made, for example, Japanese Patent No. 3336905.

Furthermore, there has been proposed an injector driving/controlling apparatus which is implemented in the circuit configuration similar to that disclosed in JP-A-1998-318025, and which apparatus is so arranged that upon detection of abnormality in an injector driving circuit, the fuel injections from all the fuel injectors sharing the injector driving circuit suffering the trouble is stopped, while the fuel injection to the cylinders which share in common the normally operating injector driving circuit is continued. For more particulars, reference may have to be made to, for example, Japanese Patent Application Laid-Open No. 112735/1997 (JP-A-1997-112735).

As is apparent from the above, in the injector driving circuits known heretofore, the power supply source for the driving circuits is partially shared by the fuel injectors on a per cylinder group basis to thereby realize inexpensive and miniaturized implementation of the driving circuits.

In this conjunction, it is however noted that with the circuit arrangement mentioned above, when a ground fault takes place at the grounded or earthed terminal of the electromagnetic coil of the fuel injector mounted on the first cylinder (e.g. when a wiring conductor extending between the electromagnetic coil of the fuel injector for the first cylinder and a switching means is electrically connected to the ground potential), the fuel injector for the first cylinder will nevertheless be driven simultaneously in synchronism with the fuel injector of the fourth cylinder which shares the driving circuit with the fuel injector of the first cylinder.

In this connection, it is assumed that the engine is of four-cylinder type, wherein the fuel is injected to the first, third, fourth and the second cylinders in this order. In that case, with the circuit configuration disclosed in JP-A-1998-318025 and in JP-A-1997-112735 in which one of the driving circuits is shared by the first and fourth cylinders, fuel injection to the first cylinder whose fuel injector suffers the ground fault is performed at the expansion stroke simultaneously with the fuel injection to the fourth cylinder performed at the suction stroke.

On the other hand, with the circuit configuration disclosed in Japanese Patent No. 3336905 in which the driving circuit is shared by the fuel injectors of all the cylinders, fuel injection to the first cylinder suffering the ground fault will always be carried out simultaneously with the driving of the fuel injectors for the second to fourth cylinders, respectively.

Furthermore, there has been proposed an apparatus designed for detecting an OFF surge voltage which makes appearance upon firing the injector coil (i.e., when electrical energization of the injector coil is interrupted or broken) for thereby detecting the wire breakage fault and the ground fault of the injector circuits en bloc. Refer to, for example, Japanese Patent Application Laid-Open No. 290111/1987 (JP-A-1987-290111). In this publication, however, no teaching is disclosed concerning the discriminative detection or identification of the wire breakage fault and the ground fault from each other.

In the apparatus described above, when the wire breakage fault takes place in the fuel injector for the first cylinder, no fuel injection is performed to the first cylinder. In that case, since the OFF surge signal drops out in relation to the first cylinder, it can be detected that the fuel injector of the first cylinder suffers abnormality.

On the other hand, in the case where the ground fault occurs in relation to the first cylinder, fuel injection to the first cylinder is carried out at the normal fuel injection timing and simultaneously in synchronism with the fuel injection timing for the fourth cylinder whose fuel injector shares the driving circuit with that of the first cylinder. In that case, although the driving switching means provided in association with the fuel injector of the first cylinder is in the off-state (i.e., turned off), the coil of the fuel injector of the first cylinder is electrically energized through the grounded location, as a result of which only the OFF surge signal for the first cylinder drops out similarly to the case where the wire breakage fault occurs as mentioned just above. In other words, although the fuel injection mode differs for the wire breakage fault and the ground fault, it can not discriminatively be identified which of the wire breakage fault and the ground fault has taken place with only the detection of the OFF surge voltage. Of course, for identifying the wire breakage fault and the ground fault discriminatively from each other, it is conceivable to provide additionally a detection circuit dedicated to this end. However, it will incur increase of the manufacturing cost, to disadvantage.

Next, let's consider a relation between the injector driving pulse and the current in the normal or ordinary operation state and the ground fault suffering state.

In the normal operation state, a high voltage is applied across the coil of the fuel injector in the initial phase of the injection valve opening operation for effectuating the injection valve opening operation at a high speed. Consequently, a large current will flow through the injector coil immediately after application of the injector driving pulse. However, after the injection valve has been opened, the hold current of a necessary minimum magnitude is caused to flow through the injector coil for holding the injection valve in the opened state while suppressing the heat generation.

On the other hand, upon occurrence of the short circuit fault, a major portion of the current flows to the injector coil, bypassing the switching means inserted between one end of the injector coil and the ground potential. Consequently, loss otherwise brought about by the switching means makes disappearance. Thus, the hold current of not a small magnitude will flow in addition to the large current flow in the initial phase of the valve opening operation, incurring increase of the heat quantity generated by the injector coil.

As is obvious from the foregoing, the injector control apparatuses for the cylinder injection type internal combustion engine known heretofore suffer a problem that the quantity of heat generated by the fuel injector increases upon occurrence of the short circuit fault.

Further, in the conventional apparatus adopting such circuit arrangement that the hold current is maintained constant through a feedback control effectuated on the basis of detection of the current flowing through the switching means, the hold current increases appreciably upon occurrence of the short circuit fault, as a result of which heat generation in the injector coil increases remarkably, incurring trouble or fault of the fuel injector and the driving circuit, giving rise to another problem.

Besides, in the case where the simultaneous fuel injection is continued, temperature of exhaust gas of the engine will increase because of the so-called after-burning, possibly incurring performance degradation of a catalyst disposed within the exhaust pipe of the engine. Moreover, because a large amount of unburned gas flows into the exhaust pipe, there may arise a possibility of spontaneous combustion of the unburned gas internally of the exhaust pipe, to a further problem.

Under the circumstances, there has been proposed the injector control apparatus for the cylinder injection type engine which is imparted with a failsafe function such that upon detection of the wire breakage fault and/or the ground fault, not only the fuel injection of the injector suffering the fault but also the fuel injection from all the other fuel injectors belonging to a same group as the fault suffering injector and sharing the driving circuit with the fault suffering injector is stopped while allowing the fuel injection from the normal injectors belonging to other group to be continued. In that case, since the fuel injection from the first cylinder (cylinder suffering the abnormality) and the fourth cylinder (normal cylinder), i.e., two cylinders in total, which share one driving circuit is stopped, the simultaneous fuel injection can certainly be avoided. However, since siding operation of the motor vehicle (i.e., operation for moving the motor vehicle to a safety zone such as a side area of a road) must then forcibly be carried out only with the two remaining cylinders (second and third cylinders), a half of the total cylinders, there may arise the possibility that engine torque as demanded can not be ensured, leading to engine stall in the worst case, to a further disadvantage.

SUMMARY OF THE INVENTION

In the light of the state of the art described above, it is an object of the present invention to provide an injector control apparatus for a cylinder injection type internal combustion engine in which the driving circuits are shared groupwise by the fuel injectors of plural cylinders and which is imparted with a function for discriminatively identifying the ground fault of the fuel injector as well as a failsafe function validated upon occurrence of the ground fault.

In view of the above and other objects which will become apparent as the description proceeds, there is provided according to a general aspect of the present invention a fuel injector control apparatus for a cylinder injection type internal combustion engine having a plurality of cylinders. The fuel injection control apparatus includes a plurality of injector groups each including a predetermined number of fuel injectors for injecting fuel into the associated cylinders, respectively, wherein driving coils for driving the fuel injectors which belong to a same injector group have one ends connected to a common potential source, a plurality of switching means connected to the common potential source of the injector groups, respectively, for turning on/off driving currents supplied to the driving coils of the fuel injectors belonging to the same group upon being fired, a fuel quantity/injection timing arithmetic means for arithmetically determining a fuel supply quantity and a fuel injection timing for the plurality of fuel injectors on the basis of information derived from outputs of various types of sensors, a plurality of driving circuits provided in correspondence to the injector groups, respectively, for generating an injector driving signal for firing the switching means in response to an output of the fuel quantity/injection timing arithmetic means, and a ground fault identifying/discriminating means for detecting occurrence of a ground fault in relation to the injector group and specifying a ground fault occurrence location at which the ground fault is taking place upon detection thereof.

The fuel quantity/injection timing arithmetic means is so designed that when the ground fault occurrence location is specified by the ground fault identifying/discriminating means, the fuel quantity/injection timing arithmetic means stops fuel injection from other fuel injector(s) of the injector group to which the fuel injector specified as suffering the ground fault belongs.

With the arrangement of the injector control apparatus for the cylinder injection type internal combustion engine according to the present invention, failsafe function can be ensured by suppressing occurrence of overcurrent or engine output when the ground fault takes place in the circuits provided in association with the fuel injectors.

The above and other objects, features and attendant advantages of the present invention will more easily be understood by reading the following description of the preferred embodiments thereof taken, only by way of example, in conjunction with the accompanying drawings.

BRIEF DESCRIPTION OF THE DRAWINGS

In the course of the description which follows, reference is made to the drawings, in which.

DESCRIPTION OF THE PREFERRED EMBODIMENTS

Figure 1:
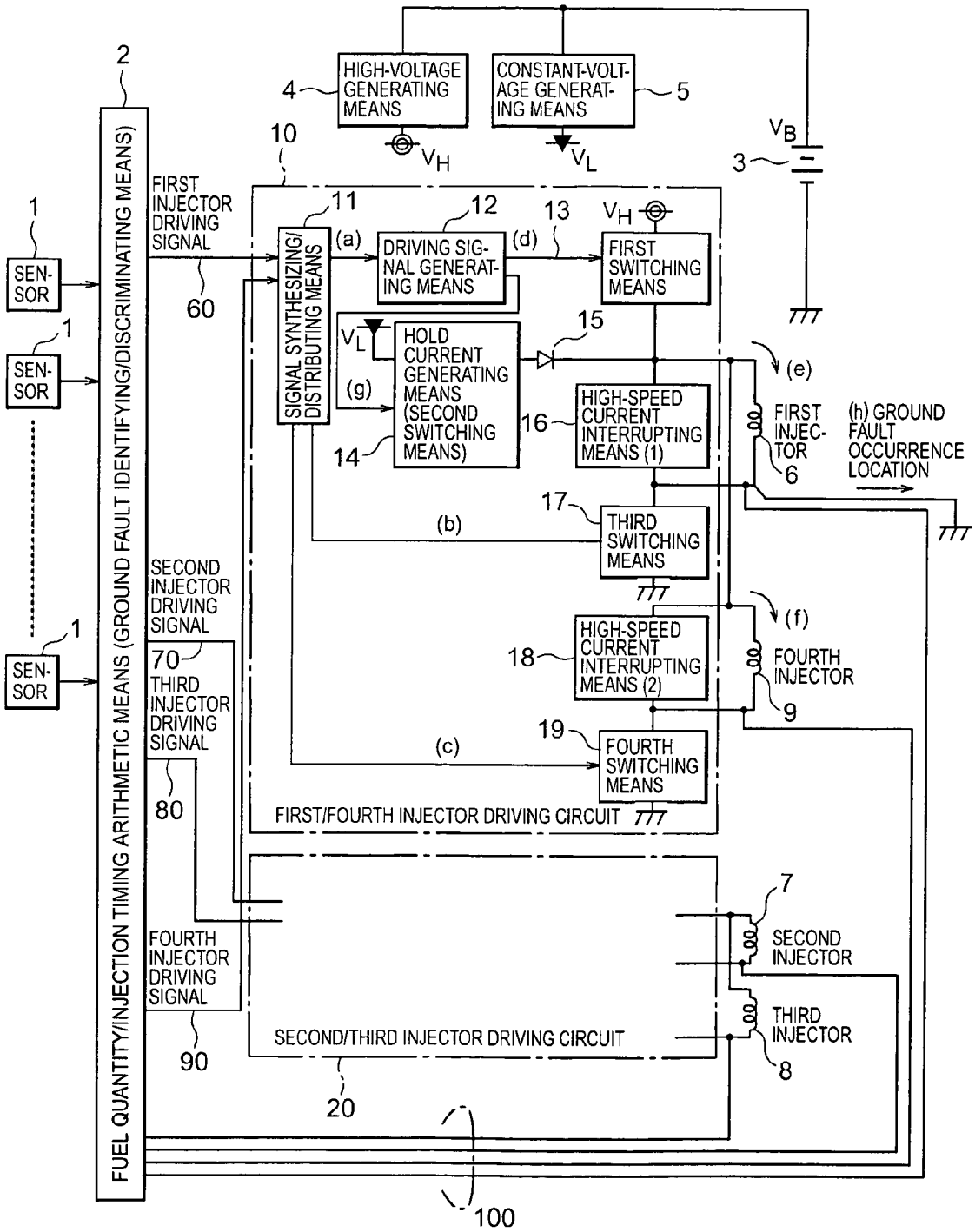
FIG. 1 is a block diagram showing generally and schematically a configuration of an injector control apparatus for a cylinder injection type internal combustion engine according to a first embodiment of the present invention.

The present invention will be described in detail in conjunction with what is presently considered as preferred or typical embodiments thereof by reference to the drawings. In the following description, like reference characters designate like or corresponding parts throughout the several views.

Embodiment 1

Now, referring to the drawings, description will be made in detail of the fuel injector control apparatus for the cylinder injection type internal combustion engine according to a first exemplary embodiment.

FIG. 1 is a block diagram showing generally and schematically a configuration of the injector control apparatus for the cylinder injection type internal combustion engine according to the first embodiment of the invention on the assumption that the engine is a conventional four cycle/four cylinder engine.

It should firstly be mentioned that a noticeable feature of the fuel injector control apparatus shown in FIG. 1 can be found in the software function of a fuel quantity/injection timing arithmetic means provided in association with the injector driving circuits.

Referring to FIG. 1, the fuel injector control apparatus is comprised of a group of various types of sensors generally denoted by reference numeral 1, a fuel quantity/injection timing arithmetic means 2 constituted by a microcomputer or microprocessor, an on-vehicle battery 3, a high-voltage generating means 4 and a constant-voltage generating means 5, injector driving coils 6, 7, 8 and 9 provided in association with the fuel injectors of the individual engine cylinders (#1 to #4), respectively, a first/fourth injector driving circuit 10 for driving the fuel injectors of the first and fourth cylinders, respectively, a second/third injector driving circuit 20 for driving the fuel injectors of the second and third engine cylinders, respectively, and a set of wiring conductors 100 interconnecting the fuel quantity/injection timing arithmetic means 2 and one ends of the driving coils of the individual fuel injectors, respectively.

The group of various types of sensors 1 includes a crank angle sensor, an air flow sensor, a throttle valve position sensor and the like known per se for detecting information concerning the operation state of the engine (not shown). Signals derived from the outputs of these sensors and indicating the detected information are inputted to the fuel quantity/injection timing arithmetic means 2.

On the other hand, the fuel quantity/injection timing arithmetic means 2 is designed to arithmetically determine a fuel injection quantity to be supplied to the engine (i.e., to the individual fuel injectors) and fuel injection timings for the injectors as required for ensuring a desired or target engine output torque on the basis of the engine operation state information derived from the output signals of the various sensors 1 to output appropriate injector driving signals 60, 70, 80 and 90, respectively.

The first/fourth injector driving circuit 10 is designed to electrically energize or excite the driving coils 6 and 9 of the first and fourth injectors in response to the first and fourth injector driving signals 60 and 90, respectively, delivered from the fuel quantity/injection timing arithmetic means 2.

Similarly, the second/third injector driving circuit 20 is designed to excite the driving coils 7 and 8 of the second and third injectors in response to the second and third injector driving signals 70 and 80, respectively, delivered from the fuel quantity/injection timing arithmetic means 2.

The fuel injectors are provided individually on a cylinder-by-cylinder basis. Thus, the number of the fuel injectors coincides with that of the cylinders. In the case of the injector control apparatus now under consideration, four fuel injectors are provided for four cylinders, respectively, since it is assumed that the engine is a four-cycle/four-cylinder engine, as mentioned previously.

The battery 3 serves as a power supply source for electrically energizing or exciting the driving coils 6 to 9 of the individual fuel injectors, respectively. Incidentally, the battery voltage is represented by VB.

The high-voltage generating means 4 is designed to boost the battery voltage VB to thereby generate a high voltage VH (higher than the battery voltage, i.e., VH>VB), while the constant-voltage generating means 5 is designed to lower the battery voltage VB to thereby generate a constant low voltage VL (lower than the battery voltage, i.e., VL<VB). The high voltage VH and the low voltage VL are then supplied to each of the driving circuits 10 and 20.

The first to fourth injector driving signals 60 to 90 selectively drive the fuel injectors of the first to fourth cylinders, respectively, through the medium of the first/fourth injector driving circuit 10 and the second/third injector driving circuit 20.

The first/fourth injector driving circuit 10 is comprised of a signal synthesizing/distributing means 11, a driving signal generating means 12, a first switching means 13, a hold current generating means (second switching means) 14, a reverse-current blocking diode 15, a high-speed current interrupting means (1) 16, a third switching means 17, a high-speed current interrupting means (2) 18 and a fourth switching means 19.

The third switching means 17 and the fourth switching means 19 are newly or additionally provided in the fuel injector control apparatus according to the teaching of the present invention incarnated in the illustrated embodiment.

At this juncture, it is to be added that although only the first/fourth injector driving circuit 10 is shown in detail in FIG. 1, it should be understood that the first/fourth injector driving circuit 10 and the second/third injector driving circuit 20 are implemented essentially identically with each other.

The signal synthesizing/distributing means 11 is designed to output an injector driving signal (a) through synthesization/distribution of the first and fourth injector driving signals 60 and 90 while outputting first and fourth selecting signals (b) and (c) in correspondence to the first and fourth injector driving signals 60 and 90, respectively.

The driving signal generating means 12 is designed to generate a driving signal (d) for driving the first and fourth fuel injectors in response to the injector driving signal (a).

The first switching means 13 is inserted in an electric power feeding path extending from the high-voltage generating means 4 to the coils 6 and 9 of the first and fourth fuel injectors and turned on/off in response to the driving signal (d) to thereby perform the on/off control of the exciting currents (e) and (f) fed to the driving coils 6 and 9 of the first and fourth injectors, respectively.

The hold current generating means (second switching means) 14 is designed to supply a hold signal (g) to the driving coils 6 and 9 of the first and fourth injectors in response to the low voltage VL and the injector driving signal (a), the hold signal (g) serving to hold the fuel injectors in the valve-opened state. Thus, the hold current generating means 14 functions as a second switching means which is closed or turned on in the injection valve-opened state while otherwise being opened or turned off.

The reverse-current blocking diode 15 is connected between the output terminal of the hold current generating means 14 and a common connecting point of the driving coils 6 and 9 of the first and fourth fuel injectors so as to prevent the output current generated by the high-voltage generating means 4 in the on-state of the first switching means 13 from flowing reversely to the output terminal of the hold current generating means 14.

The high-speed current interrupting means (1) 16 is connected in parallel with the driving coil 6 of the first fuel injector for interrupting or breaking the current flowing through the driving coil 6 at a high speed to realize a high-speed current breaking operation (OFF operation) for the first fuel injector at the appropriate turn-off timing thereof.

The third switching means 17 is connected between an end of the coil 6 and the ground potential to be turned on and off in response to the first selecting signal (b) generated by the signal synthesizing/distributing means 11 on the basis of the first injector driving signal 60.

The high-speed current interrupting means (2) 18 is connected in parallel with the driving coil 9 of the fourth fuel injector for breaking the current flowing through the coil 9 at a high speed to realize a high-speed current breaking or OFF operation for the fourth fuel injector at the appropriate turn-off timing thereof.

The fourth switching means 19 is connected between an end of the driving coil 9 and the ground potential to be turned on and off in response to the fourth selecting signal (c) generated by the signal synthesizing/distributing means 11 in response to the fourth injector driving signal 90.

Since the output terminal of the first switching means 13 and that of the hold current generating means 14 are connected in common via the reverse-current blocking diode 15 to an interconnection point of ends of the driving coils 6 and 9 of the first and fourth fuel injectors, the first/fourth injector driving circuit 10 for both of the fuel injectors of the first and fourth cylinders can be implemented as a single or unitary circuit, as can be seen in FIG. 1.

At this juncture, it should be mentioned that the first/fourth injector driving circuit 10, the second/third injector driving circuit 20 and the first, third and fourth switching means 13, 17 and 19 cooperate to constitute an injector drive control means. Further, although the switching means 13, 14, 17 and 19 are incorporated in the first/fourth injector driving circuit 10, they may be provided separately from the first/fourth injector driving circuit 10.

Further, in each of the injector driving circuits 10 and 20, the signal synthesizing/distributing means 11 constitutes a signal generating unit while the driving signal generating means 12 constitutes a driving signal output unit.

Furthermore, the hold current generating means 14 constitutes an operation hold unit functioning as the second switching means while the high-speed current interrupting means (1) 16 while the high-speed current interrupting means (2) 18 constitute high-speed breaking units, respectively.

Besides, in each of the injector driving circuits 10 and 20, the first to fourth switching means 13, 14, 17 and 19 are connected to the other ends of the individual fuel injectors independently from one another to be put into operation in response to the driving signals 60, 70, 80 and 90, respectively, in conformance with the appropriate fuel injection timings.

Additionally, the wiring conductors 100 serves to detect surge voltages making appearance upon breakage of the currents flowing through the coils 6 to 9 of the individual fuel injectors, respectively. The signals indicative of the surge voltages, respectively, are inputted to the fuel quantity/injection timing arithmetic means 2. The surge voltage mentioned above will hereinafter be referred to as the OFF surge voltage for the convenience of description. The OFF surge voltage is made use of in the fuel quantity/injection timing arithmetic means 2 for detecting en bloc the wire breakage fault and the ground fault possibly occurring in the individual injector circuits.

A predetermined number of the fuel injectors are handled as one unitary set. The fuel injectors belonging to one and the same set constitute one injector group.

In the case of the exemplary arrangement of the injector control apparatus shown in FIG. 1, the first injector (coil 6) and the fourth injector (coil 9) belong to one injector group while the second injector (coil 7) and the third injector (coil 8) belong to the other injector group.

The first/fourth injector driving circuit 10 is provided in association with the one injector group mentioned above with the second/third injector driving circuit 20 being provided in association with the other injector group. Each of the injector driving circuits 10 and 20 is designed to output an injector driving signal on the basis of the output of the fuel quantity/injection timing arithmetic means 2 to thereby activate or fire the relevant switching means.

The first fuel injector (coil 6) and the fourth fuel injector (coil 9) belonging to the same injector group have respective one ends electrically connected to each other so that potential of a same level is applied in common to the one ends of the first fuel injector (coil 6) and the fourth fuel injector (coil 9).

More specifically, the input end (upstream side) of the first fuel injector (coil 6), the input end (upstream side) of the fourth fuel injector (coil 9) and the output end (downstream side) of the first switching means 13 are connected in common to the output end (downstream side) of the hold current generating means 14 via the reverse-current blocking diode 15.

Further, a plurality of the switching means are connected in common to each of the injector groups.

More specifically, in the case of the injector control apparatus shown in FIG. 1, the potential appearing at one ends of the first and second switching means 13 and 14 and the high-speed current interrupting means 16 and 18 is applied in common to one ends of the first and fourth fuel injectors (coils 6 and 9) which belong to one of the injector groups.

Furthermore, the input end (upstream side) of the third switching means 17 is electrically connected to the output end (downstream side) of the high-speed current interrupting means (1) 16, while the input end (upstream side) of the fourth switching means 19 is connected to the output end of (downstream side) of the high-speed current interrupting means (2) 18.

With the circuit arrangement described above, in the state where both of the first and third switching means 13 and 17 are turned on (i.e., on-state), the high voltage VH supplied from the high-voltage generating means 4 is applied across the driving coil 6 of the first injector, resulting in that the driving current flows through the coil 6 of the first injector.

On the other hand, when both of the second and third switching means 14 and 17 are in the closed state (i.e., on-state), the low voltage VL supplied from the constant-voltage generating means 5 is applied across the driving coil 6 of the first injector, resulting in that the driving current flows through the coil 6 of the first injector.

When the first and fourth switching means 13 and 19 are both in the closed state (i.e., on-state), the high voltage VH supplied from the high-voltage generating means 4 is applied across the driving coil 9 of the fourth injector, whereby the driving current flows through the coil 9 of the fourth injector.

Further, when both the second and fourth switching means 14 and 19 are in the closed state, the low voltage VL supplied from the constant-voltage generating means 5 is applied across the coil 9 of the fourth injector, as result of which the driving current flows through the coil 9 of the fourth injector.

Incidentally, power supply to the high-voltage generating means 4 and the constant-voltage generating means 5 are made from the on-vehicle battery 3.

The fuel quantity/injection timing arithmetic means 2 incorporates therein a ground fault identifying/discriminating means (see FIG. 1) for identifying discriminatively occurrence of the ground fault in association with any one of the plural fuel injectors (coils 6, 7, 8 and 9). When a ground fault takes place between the fuel injector and the switching means located on the downstream side of that fuel injector and is detected, the ground fault occurring location is specified by the ground fault identifying/discriminating means. Then, the fuel quantity/injection timing arithmetic means 2 interrupts or stops the fuel injection from the other fuel injector of the group to which the injector suffering the ground fault belongs. In other words, the fuel injection into the other cylinder of the group to which the cylinder having relation to the ground fault belongs is stopped.

By way of example, when a ground fault occurs solely in association with the first cylinder (#1), the fuel injection to the fourth cylinder (#4) is stopped. On the other hand, in the case where the ground fault occurs simultaneously in association with the first cylinder (#1) and the second cylinder (#2), respectively, the fuel injection to the fourth cylinder (#4) and the third cylinder (#3) is also stopped.

Similarly, when the ground fault occurs simultaneously in association with the first cylinder (#1) and the third cylinder (#3), the fuel injection to the fourth cylinder (#4) and the second cylinder (#2) is also stopped. On the other hand, in case the ground fault occurs simultaneously in association with the first cylinder (#1) and the fourth cylinder (#4), the fuel injection to both the fourth cylinder (#4) and the first cylinder (#1) is stopped.

Incidentally, the concrete processing procedure or operation executed by the ground fault identifying/discriminating means for the individual cylinders will be described in detail later on in conjunction with a third embodiment of the invention by reference to FIG. 5.

By virtue of the arrangement in which the first/fourth injector driving circuit 10 is provided in common to the fuel injectors for the first and fourth cylinders with the second/third injector driving circuit 20 being provided in common to the fuel injectors for the second and third cylinders, the number of the driving circuits can be decreased to a half of that of the cylinders (i.e., two driving circuits for the four cylinders), whereby the manufacturing cost of the fuel injector control apparatus can be reduced correspondingly.

Figure 2:
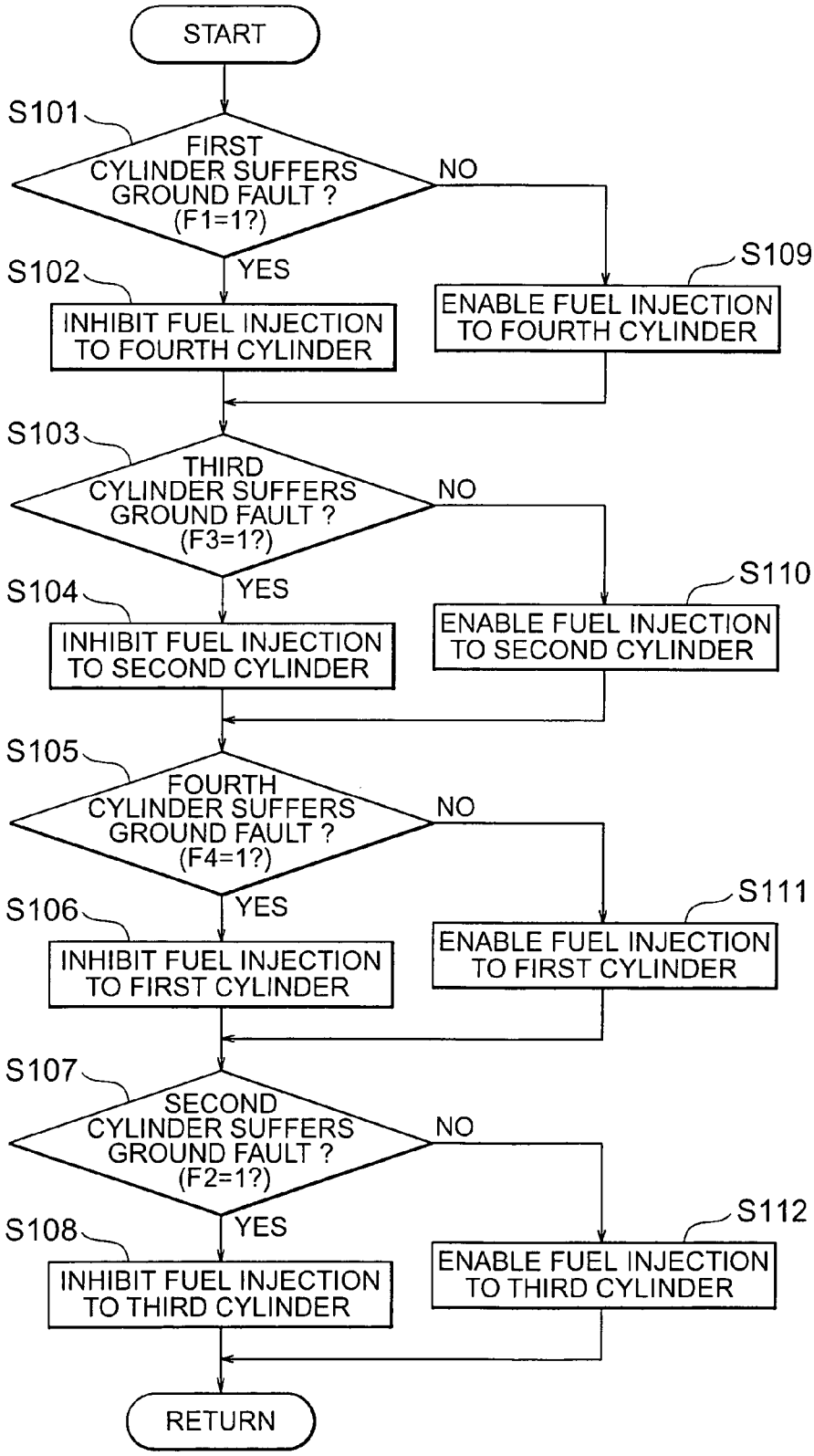
FIG. 2 is a flow chart for illustrating a fuel injection control operation performed by the fuel injector control apparatus according to the first embodiment of the invention.

Now, description will turn to operation of the injector control apparatus according to the first embodiment of the present invention by referring to FIG. 2 together with FIG. 1.

FIG. 2 is a flow chart for illustrating the fuel injection control operation performed by the fuel injector control apparatus according to the first embodiment of the invention.

Referring to FIG. 2, decision is firstly made in a step S101 as to whether or not the first cylinder has been determined as suffering from a ground fault by referencing a ground fault flag F1 assigned to the first cylinder and deciding whether F1="1" or F1="0".

When it is decided in the step S101 that F1="1" (i.e., when the step S101 results in affirmation "YES"), then the fuel injection to the fourth cylinder constituting a member of the same group as the first cylinder is inhibited (stopped) in a step S102, whereon the processing proceeds to a decision step S103 for the third cylinder.

On the other hand, when it is decided that F1="0" (i.e., when the decision step S101 results in negation "NO"), the fuel injection to the fourth cylinder is enabled (step S109), whereon the processing proceeds to the decision step S103.

In succession, decision is made as to whether or not the third cylinder has been determined as suffering from the ground fault by referencing a ground fault flag F3 assigned to the third cylinder and deciding whether or not F3="1" (step S103).

When it is decided in the step S103 that F3="1" (i.e., when the step S103 results in "YES"), then the fuel injection to the second cylinder constituting a member of the same group as the third cylinder is inhibited in a step S104, whereon the processing proceeds to a decision step S105 for the fourth cylinder.

On the other hand, when it is decided that F3="0" (i.e., when the decision step S103 results in "NO"), the fuel injection to the second cylinder is enabled (step S110), whereon the processing proceeds to the decision step S105.

Next, decision is made as to whether or not the fourth cylinder has been determined as suffering from the ground fault by referencing a ground fault flag F4 assigned to the fourth cylinder and deciding whether or not F4="1" (step S105).

When it is decided in the step S105 that F4="1" (i.e., when the decision step S105 is "YES"), then the fuel injection to the first cylinder is inhibited in a step S106, whereon the processing proceeds to a decision step S107 for the second cylinder.

By contrast, when it is decided that F4="0" (i.e., when the decision step S105 is "NO"), the fuel injection for the first cylinder is enabled (step S111), whereon the processing proceeds to the decision step S107.

Subsequently, decision is made whether or not the second cylinder has been determined as suffering from the ground fault by referencing a ground fault flag F2 assigned to the second cylinder and deciding whether or not F2=1 (step S107).

When it is decided in the step S107 that F2="1" (i.e., when "YES" in the decision step S107), then the fuel injection for the third cylinder is inhibited in a step S108. By contrast, when it is decided that F2="0" (i.e., when "NO" in the decision step S107), the fuel injection to the third cylinder is enabled (step S112), whereon the processing leaves the routine shown in FIG. 2.

As is apparent from the above, when the first cylinder, for example, suffers the ground fault, the fuel injection to the fourth cylinder which shares the driving circuit with the first cylinder is stopped through the control processing procedure described above. Thus, the first cylinder to which the fuel is injected simultaneously with the fourth cylinder can be protected against abnormal injection due to the ground fault occurring in association with the first cylinder, as can be seen in the timing chart shown in FIG. 3.

In this way, injector driving parameter (overcurrent) and hence engine load parameter are suppressed. Thus, the failsafe function can be ensured.

Figure 3:
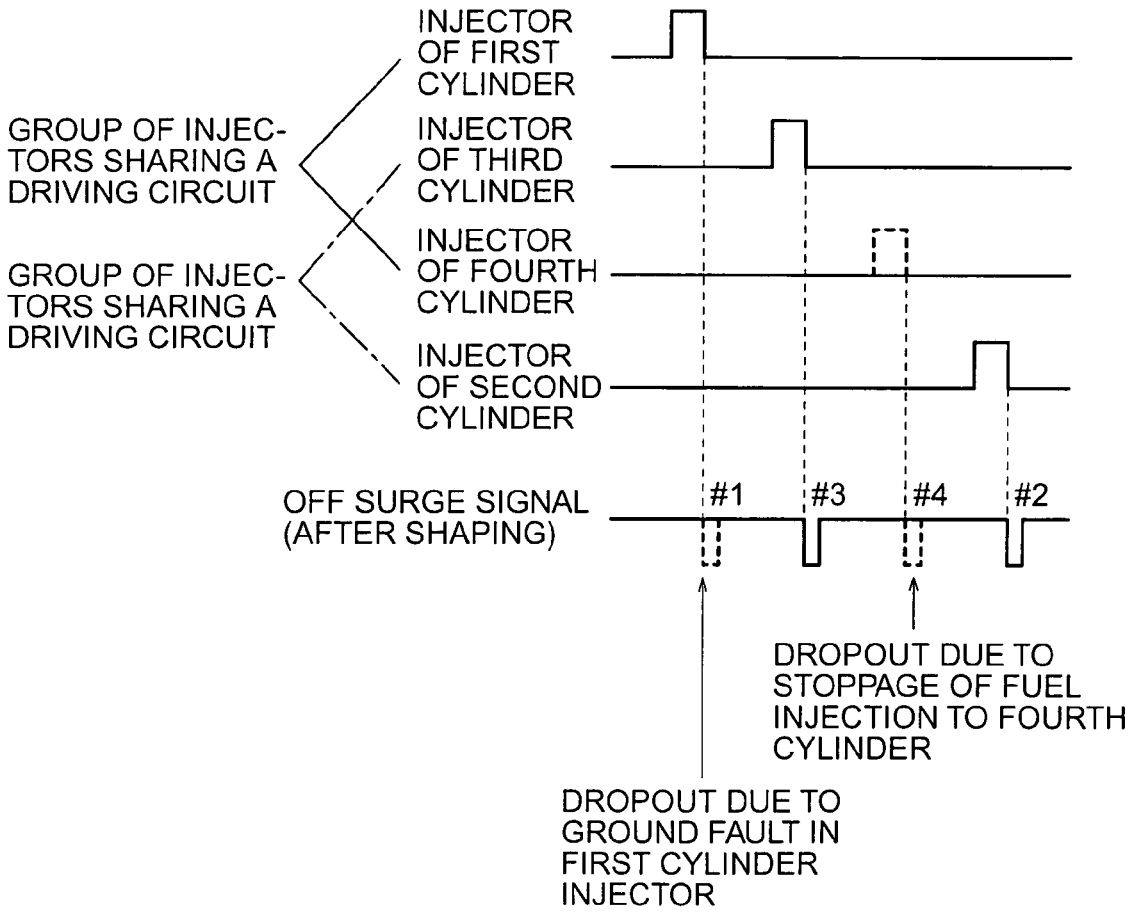
FIG. 3 is a timing chart for illustrating operation of fuel injection according to the first embodiment of the invention.

In the course of execution of the control processing procedure described above, the OFF surge signal drops out in association with the two cylinders, i.e., the first cylinder suffering the ground fault and the fourth cylinder to which the fuel injection is inhibited (see FIG. 3). It should however be understood that the so-called siding operation of the motor vehicle (i.e., moving of the motor vehicle to a safety area such as the road side or the like) can be performed with the fuel injection to the three cylinders in total, i.e., the first, the second and the third cylinders, is actually continued. In other words, the siding operation for which the engine torque as required is ensured can be carried out while avoiding the simultaneous fuel injection due to the ground fault of the fuel injector.

Embodiment 2

In the case of the injector control apparatus according to the first embodiment of the invention, the injector driving circuits are classified into two groups, wherein the fuel injection to the cylinder belonging to the same group as the cylinder determined as suffering the ground fault is stopped. In the injector control apparatus according to a second embodiment of the present invention, such arrangement is adopted that when any one of the cylinders sharing the injector driving circuit is determined as suffering the ground fault, the fuel injection to all the cylinders having the fuel injectors sharing the driving circuit is stopped.

In the following, description will be made of the injector control apparatus according to the second embodiment of the invention which is so arranged as to stop the fuel injection to all the cylinders having the fuel injectors sharing the driving circuit when occurrence of the ground fault in any one of the fuel injections is determined.

In the injector control apparatus now under consideration, the ground fault identifying/discriminating means incorporated in the fuel quantity/injection timing arithmetic means 2 is so designed to discriminatively identify the location where the ground fault occurs in association with any one of the plural fuel injectors and stop the fuel injection to all the cylinders when the ground fault occurs between the injector and the switching means.

More specifically, when the ground fault occurring location is specified by the ground fault identifying/discriminating means, the fuel quantity/injection timing arithmetic means 2 stops the fuel injection from the other fuel injectors belonging to the same group as the injector suffering the ground fault and at the same time stop the fuel injection from the fuel injectors of the other injector group as well as the fuel injection from the injector suffering the ground fault.

Now, referring to a flow chart illustrated in FIG. 4, description will be made of the processing procedure or operation for stopping the fuel injection to all the cylinders upon determination of the occurrence of the ground fault according to the teaching of the invention incarnated in the second embodiment.

Figure 4:
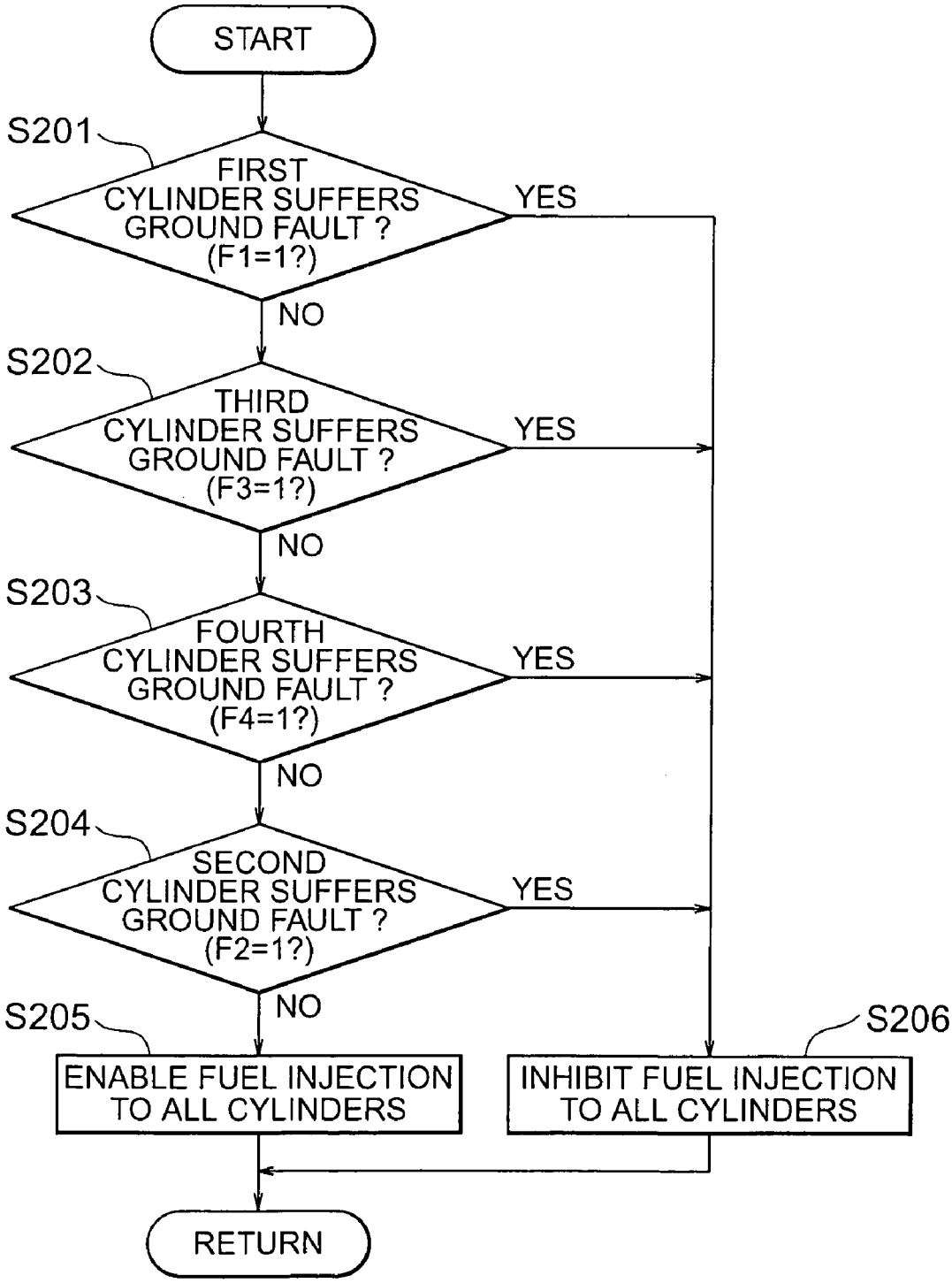
FIG. 4 is a flow chart for illustrating a fuel injection control operation performed by the fuel injector control apparatus according to a second embodiment of the present invention.

Incidentally, it should firstly be mentioned that steps S201 to S204 illustrated in FIG. 4 correspond, respectively, to the steps S101, S103, S105 and S107 described hereinbefore in conjunction with FIG. 2.

Referring to FIG. 4, decision is firstly made as to occurrence of the ground fault in association with the first cylinder by referencing a ground fault flag F1 in a step S201.

When it is decided in the step S201 that F1="1" (i.e., when "YES" in the step S201), the fuel injection to all the cylinders is inhibited in a step S206, whereon the processing leaves the routine shown in FIG. 4.

On the other hand, when it is decided in the step S201 that F1="0" (i.e., when "NO" in the step S201), then decision is made as to occurrence of the ground fault in association with the third cylinder by referencing a ground fault flag F3 in a step S202.

When it is decided in the step S202 that F3="1" (i.e., when "YES" in the step S202), the processing proceeds to the step S206, whereas when it is decided that F3="0" (i.e., when "NO" in the step S202), decision is then made by referencing a ground fault flag F4 whether or not the fourth cylinder is suffering the ground fault in a step S203.

When it is decided in the step S203 that F4="1" (i.e., when "YES" in the step S203), the processing proceeds to a step S206, whereas when it is decided that F4="0" (i.e., when "NO" in the step S203), decision is then made by referencing a ground fault flag F2 whether or not the second cylinder is suffering the ground fault in a step S204.

When it is decided in the step S204 that F2="1" (i.e., when "YES" in the step S204), the processing proceeds to the step S206, whereas when it is decided that F2="0" (i.e., when "NO" in the step S204), this means that all the cylinders suffer no ground fault. Accordingly, the fuel injection to all the cylinders is enabled (step S205), whereupon the processing exists the routine illustrated in FIG. 4.

With the control processing procedure described above, when the ground fault is taking place in association with at least one of the cylinders, the fuel injection to all the cylinders which share the driving circuit with the cylinder suffering the ground fault can be stopped.

Thus, the injector driving parameter (overcurrent) and hence the engine load parameter are positively suppressed (or avoided), as in the case of the injector control apparatus described previously, whereby the failsafe function can be ensured. In other words, a secondary accident that the engine body and component parts of the fuel system are injured due to the simultaneous fuel injection brought about by the ground fault of the fuel injector can be prevented in anticipation.

Embodiment 3

In the foregoing description of the fuel injector control apparatuses according to the first and second embodiments of the invention, no concrete consideration has been paid to the operation of the ground fault identifying/discriminating means. In the injector control apparatus according to a third embodiment of the present invention, the ground fault identifying/discriminating means is so arranged as to discriminatively decide or identify the ground fault on the basis of occurrence/nonoccurrence of the OFF surge voltage and occurrence/nonoccurrence of successive misfire, as is illustrated in, for example, FIG. 5.

In the following, description will be made of the fuel injector control apparatus according to the third embodiment of the invention which is so arranged as to make decision concerning the occurrence of the ground fault on the basis of occurrence/nonoccurrence of the OFF surge voltage and occurrence/nonoccurrence of the successive misfire.

In the fuel injector control apparatus according to the instant embodiment of the invention, the ground fault identifying/discriminating means incorporated in the fuel quantity/injection timing arithmetic means 2 includes an injection confirming means for detecting at least one of the OFF surge voltage generated upon firing of the fuel injector (i.e., upon breaking of the current flowing through the electromagnetic coil of the fuel injector) and the current flowing to and through the switching means and additionally a misfire detecting means for detecting occurrence/nonoccurrence of the misfire in the engine, wherein it is determined that the fuel injector of a particular cylinder suffers the ground fault when abnormality of the fuel injector of that particular cylinder is detected by the injection confirming means and unless complete misfire of the particular cylinder corresponding to the abnormal fuel injector is detected by the misfire detecting means.

Incidentally, the fuel quantity/injection timing arithmetic means 2 is so arranged that when occurrence of the ground fault is detected at a location between the fuel injector and the switching means for the particular cylinder, the fuel quantity/injection timing arithmetic means 2 stops the fuel injection to all the cylinders having the respective fuel injectors which share the driving circuit with the injector of the particular cylinder, as in the case of the injector control apparatus according to the second embodiment of the invention.

Now referring to a flow chart shown in FIG. 5, description will be made in detail of the ground fault identifying or discriminating operation performed by the injector control apparatus according to the third embodiment of the present invention.

In the description which follows, it is presumed that detection of the OFF surge (breakage surge) voltage is performed by the injection confirming means while that of the misfire state is carried out by the misfire detecting means.

Figure 5:
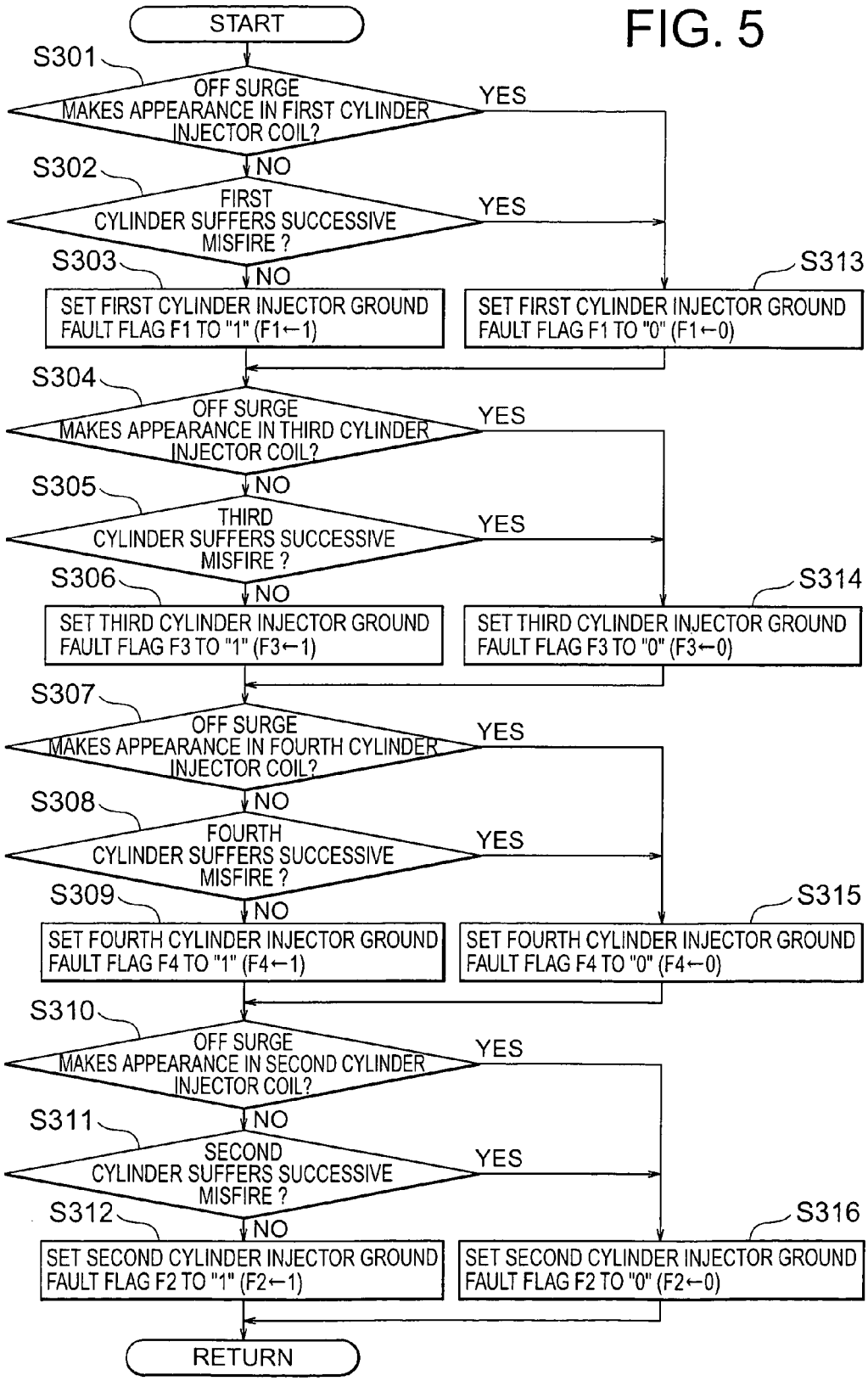
FIG. 5 is a flow chart for illustrating a fuel injection control operation performed by the fuel injector control apparatus according to a third embodiment of the present invention.

Referring to FIG. 5, it is firstly decided whether or not the OFF surge voltage has been detected in association with the first cylinder in a step S301.

When occurrence of the OFF surge is decided in the step S301 (i.e., when "YES" in the step S301), the ground fault flag F1 for the first cylinder is reset to "0" in a step S313, whereon the processing proceeds to a succeeding decision step S304 for the third cylinder.

On the other hand, when nonoccurrence of the OFF surge voltage is decided (i.e., when "NO" in the step S301), decision is then made whether or not the successive misfire in the first cylinder has been detected in a step S302.

In the case occurrence of successive misfire in the first cylinder is decided (i.e., when "YES") in the step S302, the processing then proceeds to the step S313. On the contrary, when nonoccurrence of the successive misfire in the first cylinder is decided (i.e., when "NO" in the step S302), the ground fault flag F1 for the first cylinder is set to "1" in a step S303, whereon the processing proceeds to a decision step S304.

In this way, when nonoccurrence of the OFF surge voltage and the successive misfire is decided concerning the first cylinder, then it is determined that the first cylinder is suffering the ground fault and thus the ground fault flag F1 is set, whereas when occurrence of both the OFF surge voltage and the successive misfire is determined, it is then decided that the first cylinder suffers no ground fault and thus the ground fault flag F1 is reset.

In succession, occurrence/nonoccurrence of the OFF surge voltage in association with the third cylinder is decided in the step S304. When occurrence of the OFF surge is decided in the step S304 (i.e., when "YES" in the step S304), the ground fault flag F3 for the third cylinder is reset to "0" in a step S314, whereon the processing proceeds to a succeeding decision step S307 for the fourth cylinder.

On the other hand, when nonoccurrence of the OFF surge voltage is decided in the step S304 (i.e., when "NO" in the step S304), decision is then made as to occurrence/nonoccurrence of the successive misfire in the third cylinder in a step S305.

In case the occurrence of successive misfire in the third cylinder is decided (i.e., when "YES" in the step S305), the processing then proceeds to the step S314. On the contrary, when nonoccurrence of the successive misfire in the third cylinder is decided (i.e., when "NO" in the step S305), the ground fault flag F3 for the third cylinder is set to "1" in a step S306), whereon the processing proceeds to a decision step S307.

In this way, when nonoccurrence of the OFF surge voltage and the successive misfire is decided in relation to the third cylinder, then it is determined that the third cylinder is suffering the ground fault and thus the ground fault flag F3 is set, whereas when occurrence of the OFF surge or the successive misfire is determined, it is then decided that the third cylinder suffers no ground fault and thus the ground fault flag F3 is reset.

Next, occurrence/nonoccurrence of the OFF surge voltage in relation to the fourth cylinder is decided in the step S307. When occurrence of the OFF surge voltage is decided in the step S307 (i.e., when "YES" in the step S307), the ground fault flag F4 for the fourth cylinder is reset to "0" in a step S315, whereon the processing proceeds to a succeeding decision step S310 for the second cylinder.

On the other hand, when nonoccurrence of the OFF surge voltage is decided in the step S307 (i.e., when "NO" in the step S307), decision is then made as to occurrence/nonoccurrence of the successive misfire in the fourth cylinder in a step S308.

In case the occurrence of successive misfire in the fourth cylinder is decided (i.e., when "YES" in the step S308), the processing then proceeds to the step S315, whereas when nonoccurrence of the successive misfire in the fourth cylinder is decided (i.e., when "NO" in the step S308), the ground fault flag F4 for the fourth cylinder is set to "1" in a step S309, whereon the processing proceeds to the decision step S310.

In this way, when nonoccurrence of both the OFF surge voltage and the successive misfire is decided in relation to the fourth cylinder, then it is determined that the fourth cylinder is suffering the ground fault and thus the ground fault flag F4 is set, whereas when occurrence of the OFF surge or the successive misfire is determined, it is then decided that the fourth cylinder suffers no ground fault and thus the ground fault flag F4 is reset.

Next, occurrence/nonoccurrence of the OFF surge voltage in association with the second cylinder is decided in the step S310. When occurrence of the OFF surge voltage is decided in the step S310 (i.e., when "YES" in the step S310), the ground fault flag F2 for the second cylinder is reset to "0" in a step S316, whereupon the processing exits from the processing routine shown in FIG. 5.

On the other hand, when nonoccurrence of the OFF surge voltage is decided in the step S310 (i.e., when "NO" in the step S310), decision is then made as to occurrence/nonoccurrence of the successive misfire in the second cylinder in a step S311.

In case the occurrence of the successive misfire in the second cylinder is decided (i.e., when "YES" in the step S311), the processing then proceeds to the step S316. On the contrary, when nonoccurrence of the successive misfire in the second cylinder is decided (i.e., when "NO" in the step S311), the ground fault flag F2 for the second cylinder is set to "1" in a step S312, whereupon the processing leaves the routine shown in FIG. 5.

In this way, when nonoccurrence of both the OFF surge voltage and the successive misfire is decided in relation to the second cylinder, then it is determined that the second cylinder is suffering the ground fault and thus the ground fault flag F2 is set, whereas when occurrence of the OFF surge voltage or the successive misfire is determined, it is then decided that the second cylinder suffers no ground fault and thus the ground fault flag F2 is reset.

Through the control processing procedure described above, any given cylinder of concern that suffers the ground fault can be discriminatively decided or identified on the conditions that the OFF surge voltage is not occurring and that the successive misfire is not taking place, whereby the ground fault flag relevant to that given cylinder is set.

In this manner, not only the failsafe function proper to the ground fault of the fuel injector can be realized but also the ground fault of the fuel injector can be detected without fail and without involving any appreciable increase of the manufacturing cost.

It should be mentioned that the abnormality such as wire breakage fault due to other factors than the ground fault can discriminatively be determined for a given cylinder of concern on the conditions that the OFF surge voltage does not occur and that the successive misfire is taking place, although the processing procedure to this end is not concretely illustrated in FIG. 5.

Furthermore, although the means for confirming the fuel injection on the basis of detection of the OFF surge voltage has been described, similar injection confirming operation can also be realized by detecting the current flowing to the switching means incorporated in the injector driving circuit.

Embodiment 4

In the case of the injector control apparatus according to the second embodiment of the invention, the fuel injection to all the cylinders is inhibited or disabled when the ground fault of a particular cylinder is determined. A fourth embodiment of the present invention is directed to the injector control apparatus which is so arranged in consideration of the control in the siding operation of the motor vehicle (operation of the vehicle to a safety area such as the roadside or the like) that the upper limit of the rotation number (rpm) within a range within which operation of the fuel injector is permitted (hereinafter this rotation number is referred to as the injector drive enabling rotation number (rpm)) is set to an upper limit value for the siding operation which is smaller than that in the ordinary driving or operation mode of the motor vehicle.

In the following, description will be made of the injector control apparatus according to the fourth embodiment of the invention in which the upper limit of the injector drive enabling rotation number (rpm) for the siding operation of the motor vehicle performed upon occurrence of the ground fault is preset to an upper limit value set for the siding operation.

In the injector control apparatus according to the instant embodiment of the invention, the fuel quantity/injection timing arithmetic means 2 includes a siding operation control means for performing the operation control during the siding operation or driving of the motor vehicle, wherein the siding operation control means is so designed as to control at least one of the injector driving parameter and the engine load parameter during the siding operation of the motor vehicle.

More specifically, the siding operation control means serves for limiting the upper limit of the engine rotation number (rpm) within the injector drive enabling range for the siding operation of the motor vehicle to a smaller value than a predetermined rotation number inclusive for the ordinary operation of the motor vehicle.

Now, the operation of the siding operation control means incorporated in the injector control apparatus according to the fourth embodiment of the invention will be elucidated in the concrete.

At first, description will be directed to the operation for supplying the driving pulse (driving current) to the fuel injector in general.

As described hereinbefore in conjunction with the related art, in the ordinary operation of the motor vehicle, the injector driving pulse (driving current) is supplied in such a manner that a high voltage for high-seed valve opening operation is applied in the initial phase (immediately after the driving pulse has been inputted), whereas after the injection valve has been opened, a necessary minimum hold current is supplied for holding the valve-opened state while preventing heat generation. On the other hand, upon occurrence of the ground fault, a major part of the current flows, bypassing the current path extending through the switching means (the third switching means 17 shown in FIG. 1 in the case of the first cylinder) (interposed between the downstream end of the fuel injector and the ground potential). Consequently, power loss otherwise brought about by the resistance of the switching means becomes zero. Thus, not only in the initial phase of the injection valve opening operation but also in the state where the injection valve is held opened, larger current will flow through the injector coil when compared with the current in the ordinary operation mode, which means that the amount of heat generated thereby will increase.

As is apparent from the above, when the ground fault is left as it is without any measures being taken to cope with, the amount of current flowing through the coil of the fuel injector suffering the ground fault increases, giving rise to a problem. Accordingly, it is necessary to take some proper measures for suppressing the heat generation in the fuel injector beforehand to thereby protect the injector against being damaged.

Figure 6:
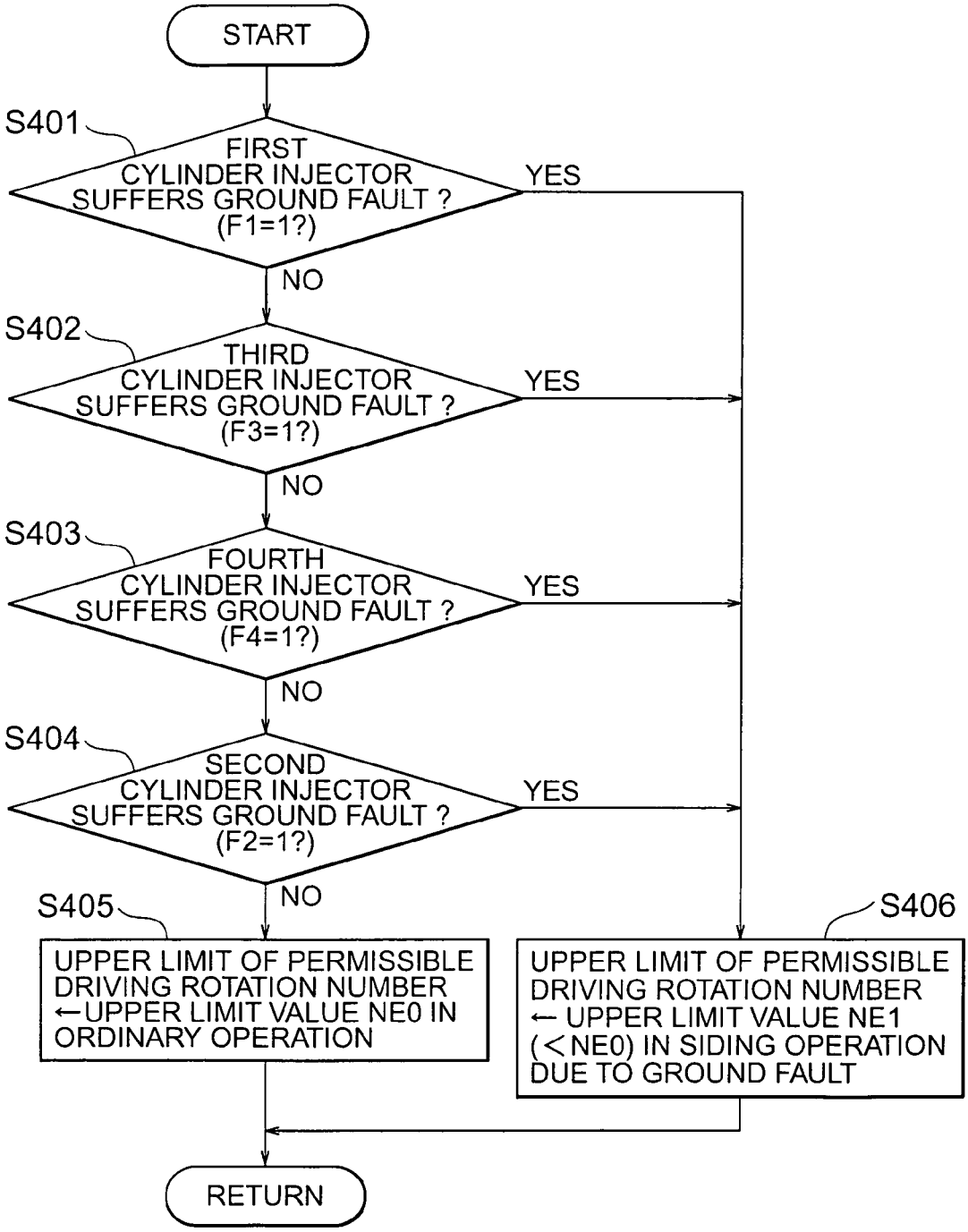
FIG. 6 is a flow chart for illustrating a fuel injection control operation performed by the fuel injector control apparatus according to a fourth embodiment of the present invention.

Under the circumstances, according to the teaching of the invention incarnated in the injector control apparatus according to the fourth embodiment, such arrangement is adopted that in the siding operation of the motor vehicle, the upper limit of the injector drive enabling rotation number (rpm) for the fuel injector is limited to a smaller value than that in the ordinary operation of the motor vehicle, to thereby suppress or decrease the frequency at which the fuel injector is put into operation in order to avoid excessive heat generation of the fuel injector, as shown in FIG. 6.

FIG. 6 is a flow chart showing a processing procedure for limiting the injector drive enabling rotation number (rpm) to the upper limit value, as mentioned above. In the figure, steps S401 to S404 correspond, respectively, to the steps S201 to S204 described hereinbefore by reference to FIG. 4.

Referring to FIG. 6, the siding operation control means firstly makes decision as to whether or not the first cylinder suffers from the ground fault by checking whether or not the ground fault flag F1 is set to "1" in a step S401.

When it is determined in the step S401 that F1="1" (i.e., when "YES" in the step S401), the upper limit of the injector drive enabling rotation number (rpm) for the fuel injector is set to an upper limit value NE1 which is preset for the ground fault and which is smaller than the upper limit value NE0 in the ordinary motor vehicle operation (step S406), whereupon the processing leaves the routine shown in FIG. 6.

On the other hand, when it is determined in the step S401 that flag F1="0" (i.e., when answer in the step S401 is "NO"), then decision is made in a step S402 as to whether or not the third cylinder suffers the ground fault (F3="1").

When it is determined in the step S402 that F3="1" (i.e., when answer in the step S402 is "YES"), the processing proceeds to a step S406, whereas when determination is made that F3="0" (i.e., when "NO") in the step S402, then decision is made as to whether or not the fourth cylinder suffers the ground fault (F4="1") in a step S403.

When it is determined in the step S403 that F4="1" (i.e., when "YES" in the step S403), the processing proceeds to the step S406, whereas when determination is made that F4="0" (i.e., when "NO") in the step S403, then decision is made as to whether or not the second cylinder suffers the ground fault (F2="1") in a step S404.

When it is determined in the step S404 that F2="1" (i.e., when "YES" in the step S404), the processing proceeds to the step S406. On the other hand, when it is determined in the step S404 that F2="0" (i.e., when "NO" in the step S404), this means that no ground fault occurs in relation with any one of the cylinders. Accordingly, the upper limit of the injector drive enabling rotation number (rpm) for the fuel injector is set to the upper limit value NE0 preset for the ordinary operation in a step S405, whereon the processing exits the routine shown in FIG. 6.

Through the processing procedure described above, the upper limit of the injector drive enabling rotation number (rpm) for the fuel injector is altered to the upper limit value NE1 which is preset for the ground fault and which is smaller than the upper limit value NE0 in the ordinary motor vehicle operation even when one of the cylinders suffers the ground fault. As a result of this, validation of the operation range in which the injector driving pulse width (energization time period of the fuel injector) increases can be avoided.

In this way, the frequency at which the fuel injector is driven is lowered in the course of the siding operation of the motor vehicle, whereby the fuel injector suffering the ground fault is protected beforehand against being excessively heated and thereby injured.

Embodiment 5

In the case of the injector control apparatus according to the fourth embodiment of the invention described above, such arrangement is adopted that in the course of siding operation of the motor vehicle performed when the ground fault has taken place in relation to the fuel injector, the upper limit of the injector drive enabling rotation number (rpm) for the fuel injectors is set to the upper limit value which is preset for the siding operation and which is smaller than that for the ordinary operation. A fifth embodiment of the invention concerns the injector control apparatus arranged such that when the ground fault occurs, the upper limit of the maximum driving pulse width for the fuel injector is so limited as not to exceed a predetermined pulse width which is narrower than that in the ordinary operation.

In the following, description will be made of the injector control apparatus according to the fifth embodiment of the present invention which is so arranged that during the siding operation of the motor vehicle performed upon occurrence of the ground fault, the upper limit imposed on the maximum injector driving pulse width is so limited as not to exceed a predetermined pulse width which is set as an upper limit value for the siding operation of the motor vehicle and which is narrower than that in the ordinary operation of the motor vehicle.

Figure 7:
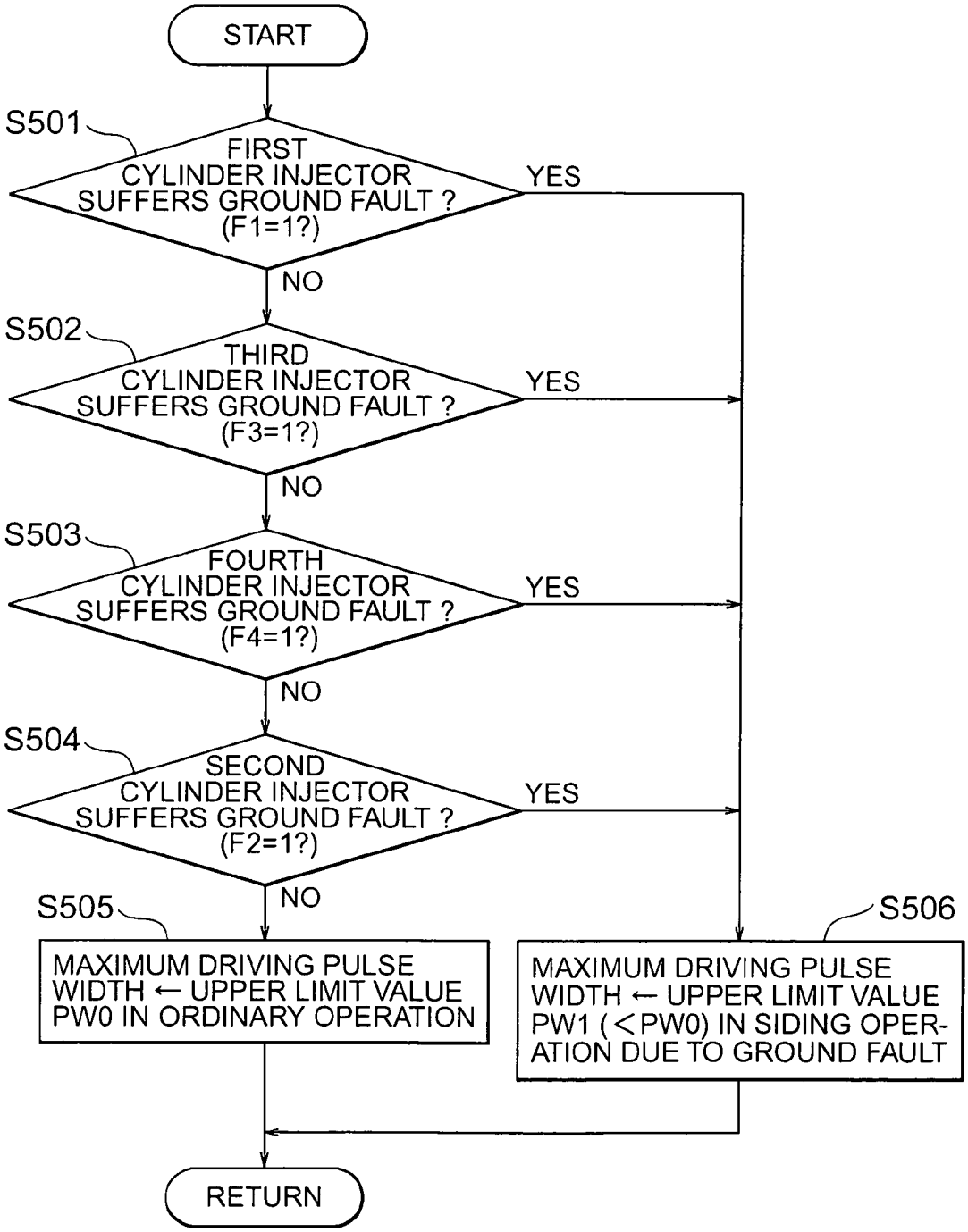
FIG. 7 is a flow chart for illustrating a fuel injection control operation performed by the fuel injector control apparatus according to a fifth embodiment of the present invention.

FIG. 7 is a flow chart showing a processing procedure for limiting the upper limit value imposed on the maximum driving pulse width, as mentioned above. In the figure, steps S501 to S504 correspond, respectively, to the steps S401 to S404 described hereinbefore by reference to FIG. 6.

Referring to FIG. 7, the siding operation control means firstly makes decision as to whether or not the fuel injector of the first cylinder suffers the ground fault (F1="1") in a step S501.

When it is determined in the step S501 that F1="1" (i.e., when "YES" in the step S501), the upper limit imposed on the maximum width of the driving pulse for driving the fuel injector is set to an upper limit value PW1 which is narrower than an upper limit value PW0 in the ordinary motor vehicle operation (step S506), whereupon the processing leaves the routine shown in FIG. 7.

On the other hand, when it is determined in the step S501 that the flag F1="0" (i.e., when the answer in the step S501 is "NO"), then decision is made in a step S502 as to whether or not the fuel injector of the third cylinder suffers the ground fault (F3="1").

When it is determined in the step S502 that F3="1" (i.e., when the answer in the step S502 is "YES"), the processing proceeds to a step S506, whereas when determination is made that F3="0" (i.e., when "NO" in the step S502), then decision is made as to whether or not the fuel injector of the fourth cylinder suffers the ground fault (F4="1") in a step S503.

When it is determined in the step S503 that F4="1" (i.e., when "YES" in the step S503), the processing proceeds to the step S506, whereas when determination is made that F4="0" (i.e., when "NO" in the step S503), then decision is made as to whether or not the fuel injector of the second cylinder suffers the ground fault (F2="1") in a step S504.

When it is determined in the step S504 that F2="1" (i.e., when "YES" in the step S504), the processing proceeds to the step S506. On the other hand, when it is determined in the step S504 that F2="0" (i.e., when "NO" in the step S504), this means that no ground fault occurs in relation with any one of the cylinders. Accordingly, the upper limit imposed on the maximum driving pulse width for the fuel injector is set to the upper limit value PW0 preset for the ordinary operation in a step S505, whereon the processing exits the routine shown in FIG. 7.

Through the processing procedure described above, the upper limit imposed on the maximum driving pulse width for the fuel injector is so set as not to exceed the upper limit value which is smaller than that in the ordinary motor vehicle operation if any one of the fuel injectors suffers the ground fault. As a result of this, validation of the operation range where the injector driving pulse width (energization time period of the fuel injector) increases can be avoided.

In this way, excessive heat generation of the fuel injector during the siding operation of the motor vehicle, whereby the fuel injector suffering the ground fault is protected beforehand against excessively heating and being thereby injured.

Embodiment 6

In the injector control apparatus according to the fifth embodiment of the invention, the upper limit imposed on the maximum driving pulse width for driving the fuel injector in the course of the siding operation of the motor vehicle performed upon occurrence of the ground fault of the fuel injector is so limited as not to exceed the predetermined pulse width (the upper limit value preset for the siding operation of the motor vehicle) which is narrower than that in the ordinary operation of the motor vehicle. A sixth embodiment of the present invention is directed to the injector control apparatus of such arrangement that upon occurrence of the ground fault in association with the fuel injector, the maximum intake air quantity of the engine is limited so as not to exceed a predetermined maximum intake air quantity which is smaller than that in the ordinary operation of the motor vehicle.

In this case, because the maximum intake air quantity of the engine is so limited as not to exceed the predetermined maximum intake air quantity which is set as the upper limit value for the siding operation and which is smaller than that in the ordinary operation of the motor vehicle in case the ground fault should occur even in one of the fuel injectors of the cylinders, the output power of the engine can be suppressed in the course of the siding operation of the motor vehicle, although illustration in this connection is omitted. Thus, validation of the operation range in which the injector driving pulse width is extended can be avoided.

In this way, excessive heating of the fuel injector can be avoided, whereby the fuel injector suffering the ground fault can be protected beforehand from the damage due to the heat generation.

Embodiment 7

In the case of the injector control apparatuses according to the fourth, fifth and the sixth embodiments of the invention described above, such arrangement is adopted that in the course of the siding operation of the motor vehicle as carried out upon occurrence of the ground fault in the fuel injector, the upper limits of the injector drive enabling rotation number (rpm), the maximum injector driving pulse width and the maximum intake air quantity of the engine, respectively, are suppressed. A seventh embodiment of the invention concerns the injector control apparatus which is arranged such that when the ground fault occurs in the fuel injector, the lower limit of a desired or target fuel pressure is set to a value which is preset higher than that in the ordinary operation of the engine so that the injector driving pulse width (energization time period) is suppressed from increasing.

In the following, description will be made of the injector control apparatus according to the seventh embodiment of the invention which is so arranged that during the siding operation of the motor vehicle performed upon occurrence of the ground fault, the lower limit of the target fuel pressure is set to a value greater than that in the ordinary operation state.

The injector control apparatus for the cylinder injection type internal combustion engine according to the instant embodiment of the invention includes a fuel pressure detecting means for detecting as the fuel pressure the pressure of the fuel injected by the fuel injector in combination with the fuel quantity/injection timing arithmetic means 2.

The fuel quantity/injection timing arithmetic means 2 incorporates not only the siding operation control means for performing the operation control during the siding operation of the motor vehicle a variable fuel pressure control means for controlling through a feedback control loop the fuel pressure in dependence on a predetermined desired pressure determined on the basis of the engine operation state by using the fuel pressure as the feedback information.

The siding operation control means incorporated in the fuel quantity/injection timing arithmetic means 2 is so designed as to set the lower limit imposed on the desired or target fuel pressure to be higher than a predetermined pressure which is higher than that in the ordinary operation during the siding operation of the motor vehicle. (The predetermined pressure mentioned above is referred to as the lower limit value for the siding operation of the motor vehicle.)

Parenthetically, the structure and operation of the fuel pressure detecting means for detecting the fuel pressure at which the fuel is injected from the fuel injector and the variable fuel pressure control means capable of performing the feedback control of the fuel pressure as detected to the desired pressure predetermined on the basis of the engine operation state have heretofore been known in the art, as disclosed in, for example, Japanese Patent Application Laid-Open Publication No. 324757/1999 and Japanese Patent No. 2623537/1999. Accordingly, descriptions of these means will be unnecessary.

Figure 8:
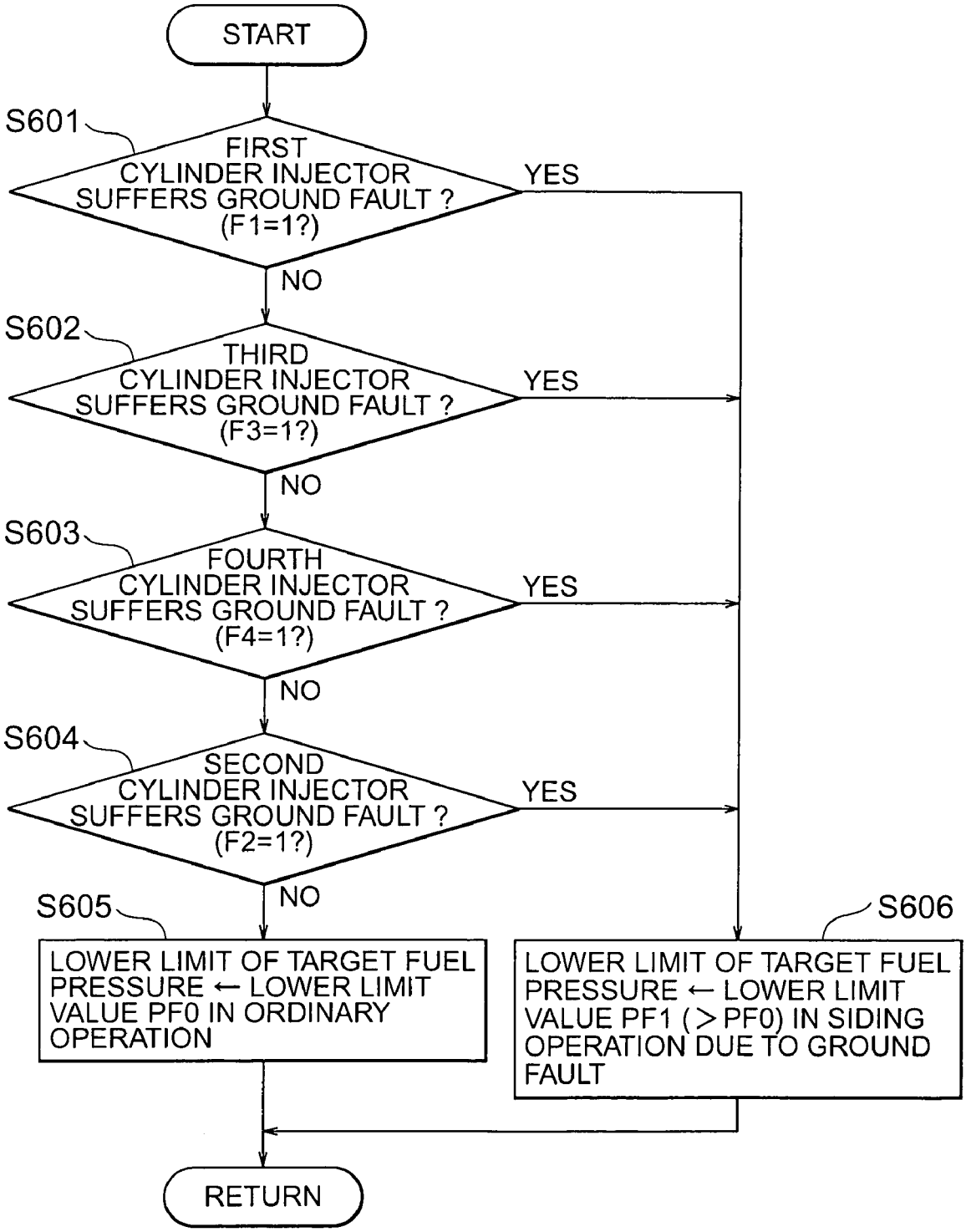
FIG. 8 is a flow chart for illustrating a fuel injection control operation performed by the fuel injector control apparatus according to a seventh embodiment of the present invention.

FIG. 8 is a flow chart showing a processing procedure for setting the lower limit imposed on the desired or target fuel pressure according to the seventh embodiment of the invention. In the figure, steps S601 to S604 correspond, respectively, to the steps S501 to S504 described hereinbefore by reference to FIG. 7.

Referring to FIG. 8, the siding operation control means firstly makes decision as to whether or not the fuel injector of the first cylinder suffers from the ground fault (whether F1="1") in a step S601.

When it is determined in the step S601 that F1="1" (i.e., when "YES" in the step S601), the lower limit imposed on the desired fuel pressure is set to a lower limit value PF1 which is higher than a lower limit value PF0 in the ordinary motor vehicle operation (step S606), whereupon the processing leaves the routine shown in FIG. 8.

On the other hand, when it is determined in the step S601 that the flag F1="0" (i.e., when answer in the step S601 is "NO"), then decision is made in a step S602 as to whether or not the fuel injector of the third cylinder suffers the ground fault (whether F3="1").

When it is determined in the step S602 that F3="1" (i.e., when answer in the step S602 is "YES"), the processing proceeds to a step S606, whereas when determination is made that F3="0" (i.e., when "NO") in the step S602, then decision is made as to whether or not the fuel injector of the fourth cylinder suffers the ground fault (whether F4="1") in a step S603.

When it is determined in the step S603 that F4="1" (i.e., when "YES" in the step S603), the processing proceeds to the step S606, whereas when determination is made that F4="0" (i.e., when "NO" in the step S603), then decision is made as to whether or not the fuel injector of the second cylinder suffers the ground fault (whether F2="1") in a step S604.

When it is determined in the step S604 that F2="1" (i.e., when "YES" in the step S604), the processing proceeds to the step S606. On the other hand, when it is determined in the step S604 that F2="0" (i.e., when "NO" in the step S604), this means that no ground fault occurs in relation with any one of the fuel injectors. Accordingly, the lower limit of the desired fuel pressure is set to the lower limit value PF0 for the ordinary operation in a step S605, whereon the processing leaves the routine shown in FIG. 8.

Through the processing procedure described above, the lower limit imposed on the target fuel pressure is changed to the lower limit value PF1 which is smaller than that in the ordinary motor vehicle operation when one of the fuel injectors of the cylinders should suffer the ground fault. As a result of this, the engine operation range where the low fuel pressure is applied can be avoided, whereby the injector driving pulse duration is suppressed from becoming longer.

Further, because the energization time period of the fuel injector is suppressed, excessive heating of the fuel injector can be avoided during the siding operation, whereby the fuel injector suffering the ground fault is protected beforehand against injury possibly brought about by the heat generation.

The reason can be explained by the fact that the width of the injector driving pulse increases as the fuel pressure becomes lower with the fuel density lowering for a same mass of fuel, while the injector driving pulse width decreases as the fuel pressure increases with the fuel density becoming higher.

Many features and advantages of the present invention are apparent from the detailed description and thus it is intended by the appended claims to cover all such features and advantages of the apparatus which fall within the spirit and scope of the invention. Further, since numerous modifications and changes will readily occur to those skilled in the art, it is not desired to limit the invention to the exact construction and operation illustrated and described.

By way of example, the arrangements described above in conjunction with the fourth to seventh embodiments of the invention may appropriately be combined to obtain synergistic effect.

Accordingly, all suitable modifications and equivalents may be resorted to, falling within the scope of the invention.

What is claimed is:

1. A fuel injector control apparatus for a cylinder injection type internal combustion engine having a plurality of cylinders, comprising:

a plurality of injector groups each including a predetermined number of fuel injectors for injecting fuel into the associated cylinders, respectively, wherein driving coils for driving said fuel injectors which belong to a same injector group have ends connected to a common potential source;

a plurality of switching means connected to said common potential source of said injector groups, respectively, for turning on/off driving currents supplied to said driving coils of said fuel injectors belonging to the same group upon being fired;

fuel quantity/injection timing arithmetic means for arithmetically determining a fuel supply quantity and a fuel injection timing for said plurality of fuel injectors on the basis of information derived from outputs of various types of sensors;

a plurality of driving circuits provided in correspondence to said injector groups, respectively, for generating an injector driving signal for firing said switching means in response to an output of said fuel quantity/injection timing arithmetic means; and ground fault identifying/discriminating means for detecting occurrence of a ground fault in relation to said injector group and specifying a ground fault occurrence location at which said ground fault is taking place upon detection thereof, wherein said fuel quantity/injection timing arithmetic means is so designed that when said ground fault occurrence location is specified by said ground fault identifying/discriminating means, said fuel quantity/injection timing arithmetic means stops fuel injection from other fuel injector(s) of the injector group to which the fuel injector specified as suffering the ground fault belongs.

2. A fuel injector control apparatus according to claim 1, wherein said fuel quantity/injection timing arithmetic means is so designed that when said ground fault occurrence location is specified by said ground fault identifying/discriminating means, said fuel quantity/injection timing arithmetic means stops not only the fuel injection from the other fuel injector(s) of the injector group to which the fuel injector specified as suffering the ground fault belongs but also the fuel injection from said fuel injector suffering the ground fault and the fuel injections from the fuel injectors belonging to the other injector group(s).

3. A fuel injector control apparatus according to claim 1, further comprising:

injection confirming means for detecting at least one of an OFF surge signal making appearance upon firing of said fuel injector and a current flowing to said switching means; and misfire confirming means for detecting occurrence/non-occurrence of misfire in said engine, wherein when abnormality of a given one of said fuel injector is detected by said injection confirming means and when occurrence of complete misfire in the cylinder corresponding to said abnormal injector is not detected by said misfire confirming means, said ground fault identifying/discriminating means determines that occurrence of the ground fault has been detected.

4. A fuel injector control apparatus according to claim 1, further comprising:

siding operation control means for carrying out operation control during a siding operation of a motor vehicle equipped with said cylinder injection type internal combustion engine, wherein said siding operation control means is designed to control at least one of driving parameter for said fuel injectors and load parameter of said engine in a suppressing direction during said siding operation.

5. A fuel injector control apparatus according to claim 4, wherein said siding operation control means is designed such that during said siding operation, an upper limit of an engine rotation number (rpm) within a range in which driving of said fuel injectors is enabled is so limited as not to exceed a predetermined engine rotation number smaller than that in an ordinary operation state of said engine.

6. A fuel injector control apparatus according to claim 4, wherein said siding operation control means is designed such that during said siding operation, an upper limit imposed on a maximum driving pulse width for said fuel injectors is so limited as not to exceed a predetermined pulse width narrower than that in an ordinary operation state of said engine.

7. A fuel injector control apparatus according to claim 4, wherein said siding operation control means is designed such that during said siding operation, a maximum intake air quantity of said engine is so limited as not to exceed a predetermined maximum intake air quantity smaller than that in an ordinary operation state of said engine.

8. A fuel injector control apparatus according to claim 4, further comprising:

fuel pressure detecting means for detecting as a fuel pressure a pressure of fuel at which said fuel is injected from said fuel injector; and variable fuel pressure control means for controlling through a feedback control said fuel pressure in accordance with a predetermined desired pressure conforming with an operating state of said engine by making use of said fuel pressure as feedback information, wherein said siding operation control means is designed that during said siding operation, a lower limit pressure of said desired fuel pressure is higher than a predetermined pressure inclusive which is higher than the fuel pressure in an ordinary operation state of said engine.

9. A fuel injector control apparatus for a cylinder injection type internal combustion engine having a plurality of cylinders, comprising:

a plurality of injector groups each including a predetermined number of fuel injectors which inject fuel into the associated cylinders, respectively, wherein driving coils which drive said fuel injectors which belong to a same injector group have ends connected to a common potential source;

a plurality of switches connected to said common potential source of said injector groups, respectively, which turn on/off driving currents supplied to said driving coils of said fuel injectors belonging to the same group upon being fired;

a fuel quantity/injection timing arithmetic circuit which arithmetically determines a fuel supply quantity and a fuel injection timing for said plurality of fuel injectors on the basis of information derived from outputs of various types of sensors;

a plurality of driving circuits provided in correspondence to said injector groups, respectively, which generate an injector driving signal which fire said switches in response to an output of said fuel quantity/injection timing arithmetic circuit; and a ground fault identifying/discriminating circuit which detects occurrence of a ground fault in relation to said injector group and specifies a ground fault occurrence location at which said ground fault is taking place upon detection thereof, wherein said fuel quantity/injection timing arithmetic circuit is so designed that when said ground fault occurrence location is specified by said ground fault identifying/discriminating circuit, said fuel quantity/injection timing arithmetic circuit stops fuel injection from other fuel injector(s) of the injector group to which the fuel injector specified as suffering the ground fault belongs.

10. A fuel injector control apparatus according to claim 9, wherein said fuel quantity/injection timing arithmetic circuit is so designed that when said ground fault occurrence location is specified by said ground fault identifying/discriminating circuit, said fuel quantity/injection timing arithmetic circuit stops not only the fuel injection from the other fuel injector(s) of the injector group to which the fuel injector specified as suffering the ground fault belongs but also the fuel injection from said fuel injector suffering the ground fault and the fuel injections from the fuel injectors belonging to the other injector group(s).

11. A fuel injector control apparatus according to claim 9, further comprising:

an injection confirming circuit which detects at least one of an OFF surge signal making appearance upon firing of said fuel injector and a current flowing to said switches; and a misfire confirming circuit which detects occurrence/nonoccurrence of misfire in said engine, wherein when abnormality of a given one of said fuel injector is detected by said injection confirming circuit and when occurrence of complete misfire in the cylinder corresponding to said abnormal injector is not detected by said misfire confirming circuit, said ground fault identifying/discriminating circuit determines that occurrence of the ground fault has been detected.

12. A fuel injector control apparatus according to claim 9, further comprising:

a siding operation control circuit which carries out operation control during a siding operation of a motor vehicle equipped with said cylinder injection type internal combustion engine, wherein said siding operation control circuit is designed to control at least one of driving parameter for said fuel injectors and load parameter of said engine in a suppressing direction during said siding operation.

13. A fuel injector control apparatus according to claim 12, wherein said siding operation control circuit is designed such that during said siding operation, an upper limit of an engine rotation number (rpm) within a range in which driving of said fuel injectors is enabled is so limited as not to exceed a predetermined engine rotation number smaller than that in an ordinary operation state of said engine.

14. A fuel injector control apparatus according to claim 12, wherein said siding operation control circuit is designed such that during said siding operation, an upper limit imposed on a maximum driving pulse width for said fuel injectors is so limited as not to exceed a predetermined pulse width narrower than that in an ordinary operation state of said engine.

15. A fuel injector control apparatus according to claim 12, wherein said siding operation control circuit is designed such that during said siding operation, a maximum intake air quantity of said engine is so limited as not to exceed a predetermined maximum intake air quantity smaller than that in an ordinary operation state of said engine.

16. A fuel injector control apparatus according to claim 12, further comprising:

a fuel pressure detecting circuit which detects as a fuel pressure a pressure of fuel at which said fuel is injected from said fuel injector; and a variable fuel pressure control circuit which controls through a feedback control said fuel pressure in accordance with a predetermined desired pressure conforming with an operating state of said engine by making use of said fuel pressure as feedback information, wherein said siding operation control circuit is designed that during said siding operation, a lower limit pressure of said desired fuel pressure is higher than a predetermined pressure inclusive which is higher than the fuel pressure in an ordinary operation state of said engine.

* * * * *